US010485731B2

(12) United States Patent
Babiuk

(10) Patent No.: US 10,485,731 B2
(45) Date of Patent: Nov. 26, 2019

(54) FASCIA MANIPULATION DEVICE AND METHOD

(71) Applicant: Craig Babiuk, Victoria (CA)

(72) Inventor: Craig Babiuk, Victoria (CA)

( * ) Notice: Subject to any disclaimer, the term of this patent is extended or adjusted under 35 U.S.C. 154(b) by 546 days.

(21) Appl. No.: 15/273,912

(22) Filed: Sep. 23, 2016

(65) Prior Publication Data

US 2017/0087041 A1 Mar. 30, 2017

Related U.S. Application Data

(60) Provisional application No. 62/232,852, filed on Sep. 25, 2015.

(51) Int. Cl.

| | |
|---|---|
| ***A61H 23/00*** | (2006.01) |
| ***A61H 23/06*** | (2006.01) |
| *A61H 15/00* | (2006.01) |

(52) U.S. Cl.

CPC ..... *A61H 23/006* (2013.01); *A61H 23/06* (2013.01); *A61H 15/0078* (2013.01); *A61H 2015/0042* (2013.01); *A61H 2023/002* (2013.01); *A61H 2201/0153* (2013.01); *A61H 2201/1207* (2013.01); *A61H 2201/1238* (2013.01); *A61H 2201/1246* (2013.01); *A61H 2201/1635* (2013.01); *A61H 2201/1685* (2013.01)

(58) Field of Classification Search

CPC ..... A61H 23/00; A61H 23/006; A61H 23/06; A61H 2023/002; A61H 2023/0227; A61H 2015/0042; A61H 15/0078; A61H 2201/0153; A61H 2201/1685; A61H 2201/1635; A61H 2201/1246; A61H 2201/1207; A61H 2201/1238; A61H 1/00; A61H 1/006; A61H 1/008; A61H 2201/1253; A61H 2201/1409; A61H 31/004; A61H 31/007; B25G 1/00; B25G 1/01

USPC ..... 81/120–127; 606/237, 238, 239

See application file for complete search history.

(56) References Cited

U.S. PATENT DOCUMENTS

| | | | | |
|---|---|---|---|---|
| 5,632,765 A | | 5/1997 | Holder | |
| 5,656,017 A | * | 8/1997 | Keller | A61H 1/008 601/107 |
| 5,931,850 A | * | 8/1999 | Zadini | A61B 17/0218 604/98.01 |
| 6,264,637 B1 | * | 7/2001 | Hogan | A01K 11/00 604/191 |
| 6,379,375 B1 | * | 4/2002 | Fuhr | A61H 1/008 601/107 |

(Continued)

OTHER PUBLICATIONS

Activator Methods, "Activator Methods Adjustment Instruments", page from company website, 1 page, Phoenix, Arizona.

*Primary Examiner* — Justine R Yu
*Assistant Examiner* — Matthew R Moon
(74) *Attorney, Agent, or Firm* — Tomlinson McKinstry, P.C.

(57) ABSTRACT

A device, and the use thereof, for imparting shearing force to superficial and deep fascial layers to improve soft tissue mobility and function. Embodiments of the invention include three general components: a strike head, a force transmitter and a patient interface. A strike force generated at or by the strike head is transmitted by the force transmitter (and normalized/modulated in the case of the force modulator version of the force transmitter) to the patient interface and then to patient tissue.

18 Claims, 9 Drawing Sheets

(56) References Cited

U.S. PATENT DOCUMENTS

| | | | | |
|---|---|---|---|---|
| 6,503,211 | B2 * | 1/2003 | Frye | A61H 1/008 601/107 |
| 8,083,699 | B2 | 12/2011 | Colloca et al. | |
| 9,839,572 | B2 * | 12/2017 | Howson | A61H 7/001 |
| 2007/0270727 | A1 * | 11/2007 | Khorassani Zadeh | A61H 1/008 601/120 |
| 2009/0043231 | A1 * | 2/2009 | Murugan | A61H 1/008 601/101 |
| 2012/0330200 | A1 * | 12/2012 | Voss | A61H 31/004 601/41 |

* cited by examiner 104
182
170
220
168
172
186
184
210
158
190
176
194
192
152
202
156
204
200
136
130
150
140
242
138
244
134
115
240
250

FASCIA MANIPULATION DEVICE AND METHOD

CROSS REFERENCE TO RELATED APPLICATIONS

This application claims the benefit of U.S. Provisional Patent Application No. 62/232,852, filed 25 Sep. 2015.

FIELD

The present invention relates to the field of physical therapy.

BACKGROUND

In anatomy, a fascia is a band or sheet of connective tissue, primarily collagen, beneath the skin that attaches, stabilizes, encloses, and separates muscles and other internal organs. Fascia is classified by layer, as superficial fascia, deep fascia, and visceral or parietal fascia, or by its function and anatomical location. As with ligaments and tendons, fascia is made up of fibrous connective tissue containing closely packed bundles of collagen fibers oriented in a wavy pattern parallel to the direction of pull. Fascia is consequently flexible and able to resist great unidirectional tension forces until the wavy pattern of fibers has been straightened out by the pulling force.

Fasciae are normally thought of as passive structures that transmit mechanical tension generated by muscular activities or external forces throughout the body. The function of muscle fasciae is to reduce friction of muscular force. In doing so, fasciae provide a supportive and movable wrapping for nerves and blood vessels as they pass through and between muscles. Some fascial tissues are also able to store and release kinetic energy.

In recent years, advancements in understanding of fascial anatomy and physiology have provided a new theoretical framework for manipulation of this tissue subsystem of the body. Under this new framework, fascia are thought of as being multi laminar, mesh-like systems of soft tissue in which movement between layers is important to normal and healthy tissue function, as well as range of motion.

Changes in the density, stiffness and/or shearing ability of the fascial tissue can lead to maladaptive restrictions in the mechanical capacity of these tissues. These changes in turn can result in chronic pain and loss of function. When inflammatory fasciitis or trauma causes fibrosis and adhesions, fascial tissue fails to differentiate the adjacent structures effectively. This can happen after surgery where the fascia has been incised and healing includes a scar that traverses the surrounding structures.

Other conditions can also affect fascia. For example Dupuytren's contracture is a flexion contracture of the hand due to a palmar fibromatosis, in which the fingers bend towards the palm and cannot be fully extended. It is an inherited proliferative connective tissue disorder that involves the hand's palmar fascia. In patients with this condition, the palmar fascia thickens and shortens so that the tendons connected to the fingers cannot move freely.

It has been suggested that it is desirable to apply a sustained and repetitive shearing force on the skin of the person suffering the maladaptive fascial restrictions to mobilize the superficial and deep fascial tissues.

Mechanical devices designed for manipulation of patient tissue are known, including the Chiropractic Activator™ sold by Activator Methods International Ltd. of Phoenix Ariz.; the Torque Release Integrator™ (U.S. Pat. No. 5,632,765); and the Impulse iQ Adjusting Instrument™ sold by Neuromechanical Innovations of Chandler Ariz. However, the known such mechanical devices are intended for chiropractic manipulation for treatment of mechanical disorders of the musculoskeletal system, especially the spine, and are not configured for applying shearing force to the skin.

SUMMARY

The present invention provides a device configured to translate a linear blow from either a striking device such as a mallet or some form of secondary force producer (i.e. compressed air) into a rapid translational impulse force at the skin's surface, intended to provide rapid traction between two or more layers of fascial tissue that when directed along the axis of restriction of maladaptively shortened collagen tissue, will tend to break/free said fibrotic tissue and improve mobility. Embodiments of the invention include three general components: a strike head, a force transmitter and a patient interface. A strike force generated at or by the strike head is transmitted by the force transmitter (and normalized/modulated in the case of the force modulator version of the force transmitter) to the patient interface and thence to patient tissue.

In general terms, the strike head is a component that enables the user to impart a strike force. The strike head may be a component configured to receive impact from the user's choice of striking device (e.g., the user's hand, a mallet etc.). The strike head may be a component configured to generate strike forces, for example the strike head may be hydraulic, pneumatic, electromagnetic, motor driven etc.

The force transmitter includes two versions, a direct transmitter (comprising a rigid body through which a strike force is directly conveyed); and a force modulator (which normalizes/modulates a strike). The force modulator includes two components in slidable engagement with each other between a start position and a collapsed position. Magnetic attraction between the two components tends to maintain the force modulator in the start position. A strike force insufficient to break the magnetic attraction is essentially conveyed directly through the force modulator. A strike force greater than the force required to break the magnetic attraction is in part (being the part up to the break force) directly conveyed through the force modulator and in part dissipated by movement from the start position toward the collapsed position. Preferably, the force modulator includes a magnetic repulsion between the two force modulator components in the collapsed position, to assist the force modulator in moving toward the start position.

Testing suggests that a break force, i.e., the force required to break the magnetic attraction engagement between the two force modulator components in the start position, in the range of about 10 pounds to about 60 pounds, may be suitable depending on the thickness of the patient tissue and the strength of the fascial adhesions. For, patient tissue other than those thick tissues that tend to have strong fascial adhesions (e.g., the thighs and buttocks), a break force in the range of about 10 pounds to about 20 pounds is understood to be suitable. A break force in the range of about 12 pounds to about 17 pounds is more preferable. A break force of about 14 pounds to about 15 pounds is most preferable.

The patient interface is used to convey the force conveyed from the force transmitter to the skin of a patient, as a rapid translational impulse force. The patient interface includes a patient contact surface configured to provide some frictional engagement with patient skin while being non-abrasive (and preferably non-permeable and washable). The patient interface preferably comprises a plurality of interchangeable patient pads (having different shapes, sizes and contact surface materials) and one or more adaptors (e.g., for altering the angle of the patient contact surface relative to the strike force).

In one aspect, the present invention provides a modular configurable device including: interchangeable strike heads, being a manual strike head and a pneumatic strike head; interchangeable force transmitters, being a direct transmitter and a force modulator; and a patient interface comprising a plurality of interchangeable patient pads and one or more adaptors. The modular configurability assists the user to apply a desired force (including in terms of strength, orientation, contact area, contact shape etc.) to facilitate fascial mobilization for different body locations and injuries/conditions.

In another aspect, the present invention provides a device for use in imparting force to tissue of a patient in need thereof, the device including: a force modulator comprising: a body, a member supported by and linearly moveable relative to the body between a start position and a collapsed position; the body includes a first body ferromagnetic component; the member includes a member ferromagnetic component; wherein a start magnetic attraction engagement between the first body ferromagnetic component and the member ferromagnetic component tends to maintain the member in the start position; a strike means for conveying a strike force to the member; and a patient interface for conveying a force from the body to skin of a patient; wherein: a strike force conveyed to the member that is insufficient to break the start magnetic attraction engagement, is substantially wholly conveyed to the skin of the patient via the body and patient interface; and a strike force conveyed to the member that is sufficient to break the start magnetic attraction engagement, is in part conveyed to the skin of the patient via the body and patient interface and in part dissipated by movement of the member toward the collapsed position.

A break force required to break the magnetic attraction engagement may be about 10 pounds to about 60 pounds. The break force may be about 10 pounds to about 20 pounds. The break force may be about 12 pounds to about 17 pounds. The break force may be about 14 pounds to about 15 pounds.

The member ferromagnetic component may be a magnetic field source; and the body may include a collapse magnetic field source; wherein a magnetic repulsion between the member ferromagnetic component and the collapse magnetic field source tends to cause the member to move away from the collapsed position.

The patient interface may include a plurality of patient pads, interchangeably releasably attachable to the body; each patient pad may include a pad ferromagnetic component; and the releasable attachment of each patient pad to the body may involve magnetic attraction between the pad ferromagnetic component and the collapse magnetic field source.

The patient interface may include at least one adaptor for releasable interconnection between one of the patient pads and the body, each adaptor including: an adaptor ferromagnetic component, wherein the releasable interconnection between the adaptor and the body involves magnetic attraction between the adaptor ferromagnetic component and the collapse magnetic field source; and an adaptor magnetic field source, wherein the releasable interconnection between the adaptor and the one of the patient pads involves magnetic attraction between the adaptor magnetic field source and the pad ferromagnetic component. The at least one adaptor may include a 45 degree adaptor.

The patient pads may include: at least one planar pad having a substantially planar patient contact surface; and at least one curved pad having a curved patient contact surface. The at least one planar pad may include: a small triangular pad having a triangle side dimension of about 75 mm to about 85 mm; a medium triangular pad having a triangle side dimension of about 95 mm to about 105 mm; and a large triangular pad having a triangle side dimension of about 120 mm to about 140 mm; and the at least one curved pad may include a spherical pad having a diameter of about 55 mm to about 70 mm.

The body may have an inner chamber; the first body ferromagnetic component and collapse magnetic field source may be disposed adjacent the inner chamber in a spaced apart relationship; and the member may be a piston assembly wherein, the linear movement of the member is movement of the piston assembly relative to the inner chamber, and the member ferromagnetic component is disposed within the inner chamber between the first body ferromagnetic component and collapse magnetic field source.

The first body ferromagnetic component may have a center hole therethrough; the piston assembly may include a piston rod extending through the center hole, and having longitudinal axis and a piston rod distal end; and the member ferromagnetic component may be affixed to the piston rod in the vicinity of the piston rod distal end; wherein movement between the start position and collapsed position involves longitudinal movement of the piston rod within the center hole.

The first body ferromagnetic component may be a first rare earth magnet, wherein the average force required in a straight pull to disengage the first rare earth magnet from a steel plate is about 65 pounds to about 75 pounds; the member ferromagnetic component may include two second rare earth magnets abutting each other under mutual magnetic attraction, wherein for each second rare earth magnet, the average force required in a straight pull to disengage the second rare earth magnet from a steel plate is about 17 pounds to about 23 pounds. The collapse magnetic field source may be a third rare earth magnet, wherein the average force required in a straight pull to disengage the third rare earth magnet from a steel plate is about 17 pounds to about 23 pounds; in the start position, a start distance between the first rare earth magnet and the second rare earth magnets, is no more than about 1.2 mm; and in the collapsed position: a collapsed distance between the first rare earth magnet and the second rare earth magnets, is between about 25 mm and about 35 mm; and a repulsion distance between the second rare earth magnets and the third rare earth magnets is between about 5 mm and 15 mm.

The strike means may be a manual strike head for receiving a strike force imparted directly or indirectly manually by a user. The strike means may be a pneumatic device having an inlet for connection to a pressurized gas supply and a control trigger, for imparting a strike force responsive to user trigger manipulation.

In another aspect, the present invention provides a modular configurable device for use in imparting force to tissue of a patient in need thereof, the device including: user interchangeable strike head components, comprising: a manual strike head for receiving a strike force imparted directly or indirectly manually by a user; and a pneumatic device having an inlet for connection to a pressurized gas supply and a control trigger, for imparting a strike force responsive to user trigger manipulation; user interchangeable force transmitter components, comprising: a direct transmitter comprising a rigid body through which a strike force is directly conveyed; and a force modulator comprising a body including a first body ferromagnetic component, a member supported by and linearly moveable relative to the body between a start position and a collapsed position, and including a member ferromagnetic component, wherein a start magnetic attraction engagement between the first body ferromagnetic component and the member ferromagnetic component tends to maintain the member in the start position; and user interchangeable patient interface components; wherein when in use, a strike force generated at or by the user selected strike head is transmitted by the user selected force transmitter to the user selected patient interface and thence to patient tissue.

In another aspect, the present invention provides for use of any of the devices described herein in the treatment of maladaptive fascial restrictions in persons in need thereof.

BRIEF DESCRIPTION OF THE DRAWINGS

FIG. 2 is a perspective exploded view of a force modulator of the modular fascia manipulation tool embodiment.

DETAILED DESCRIPTION OF THE DRAWINGS

Figure 1:
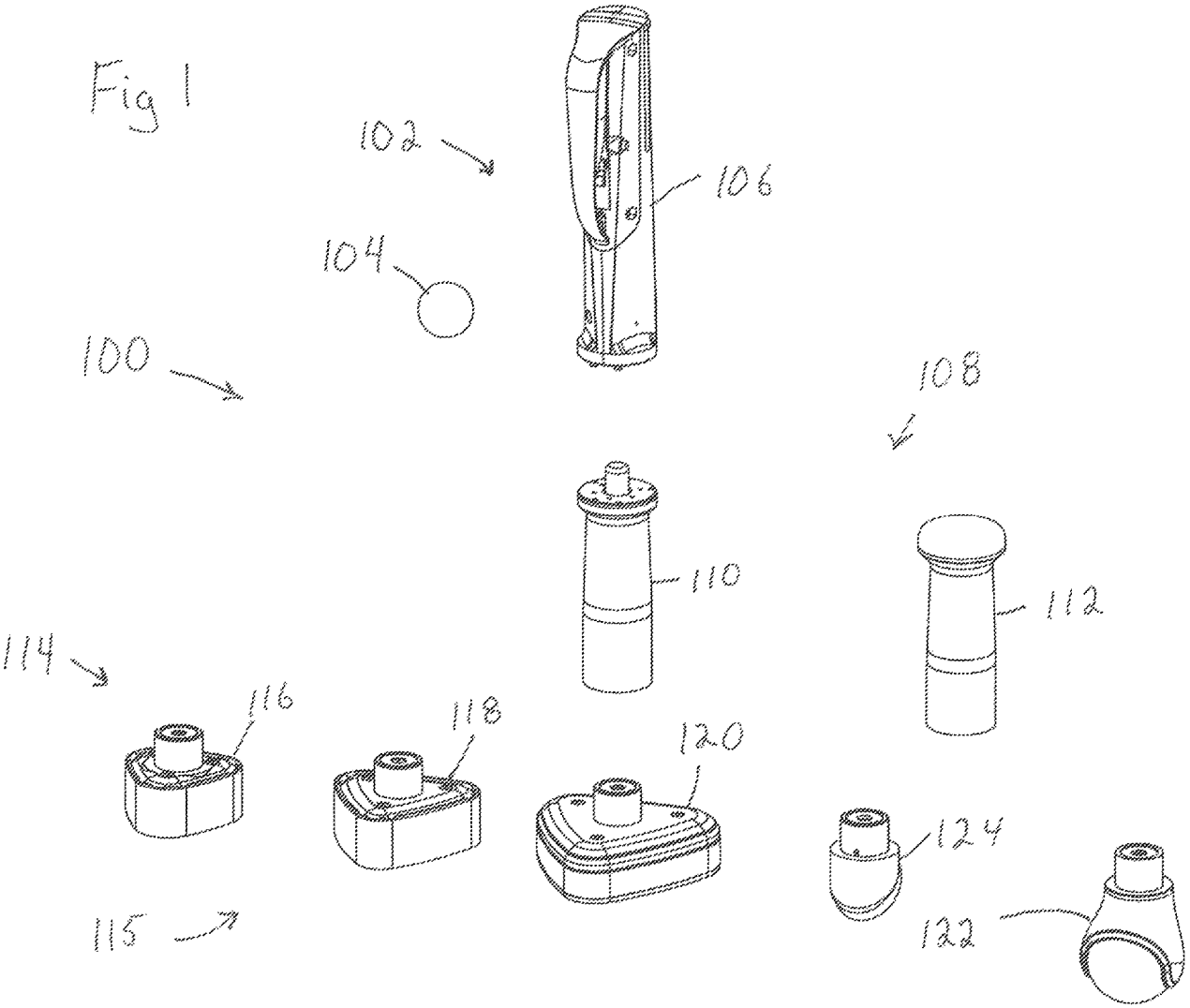
FIG. 1 is a perspective schematic view of the components of a modular fascia manipulation tool embodiment of the present invention.
Figure 7:
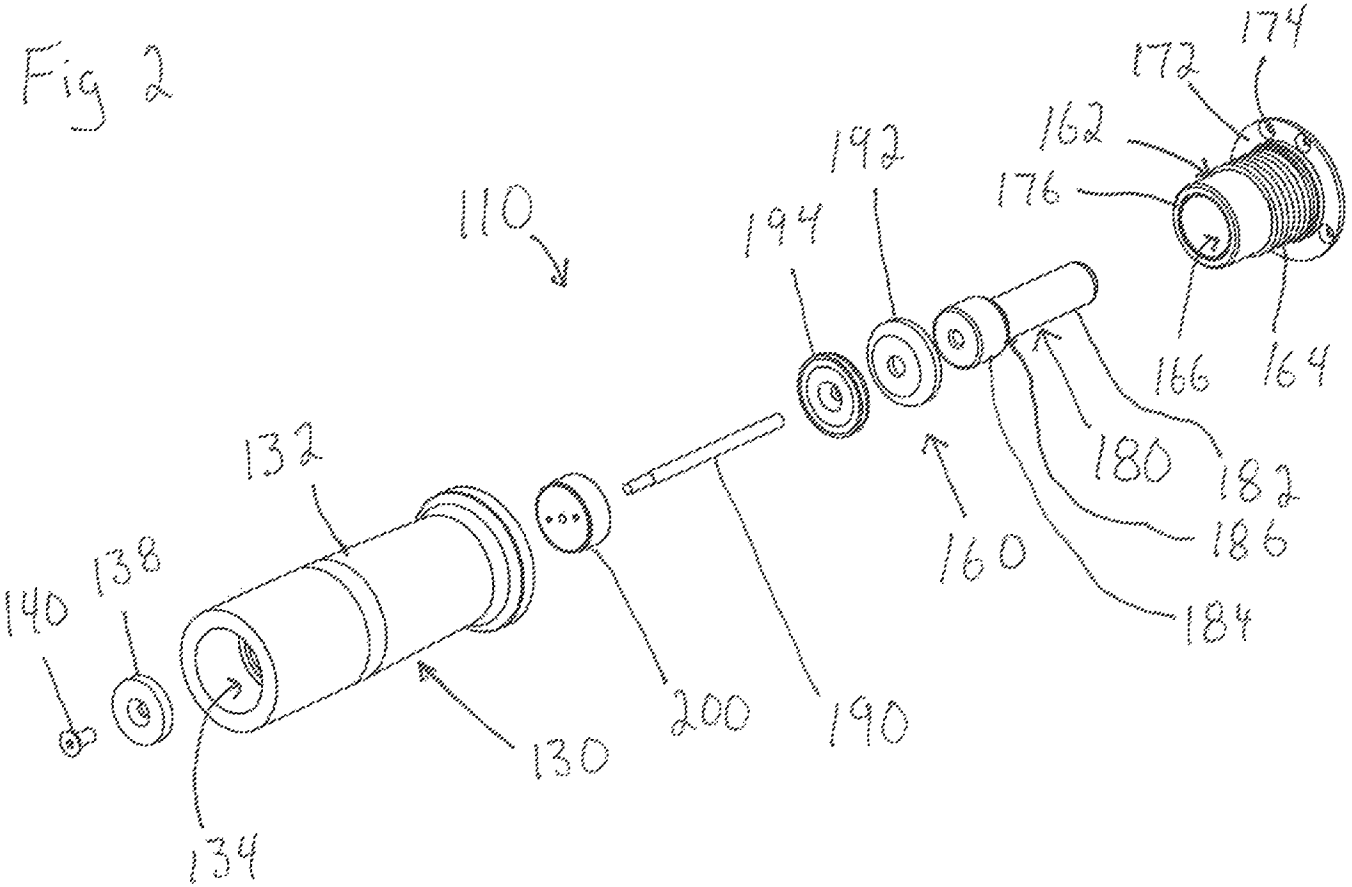
FIG. 7 is a side elevation sectional view of a direct transmitter configuration of the modular fascia manipulation tool embodiment.
Figure 3:
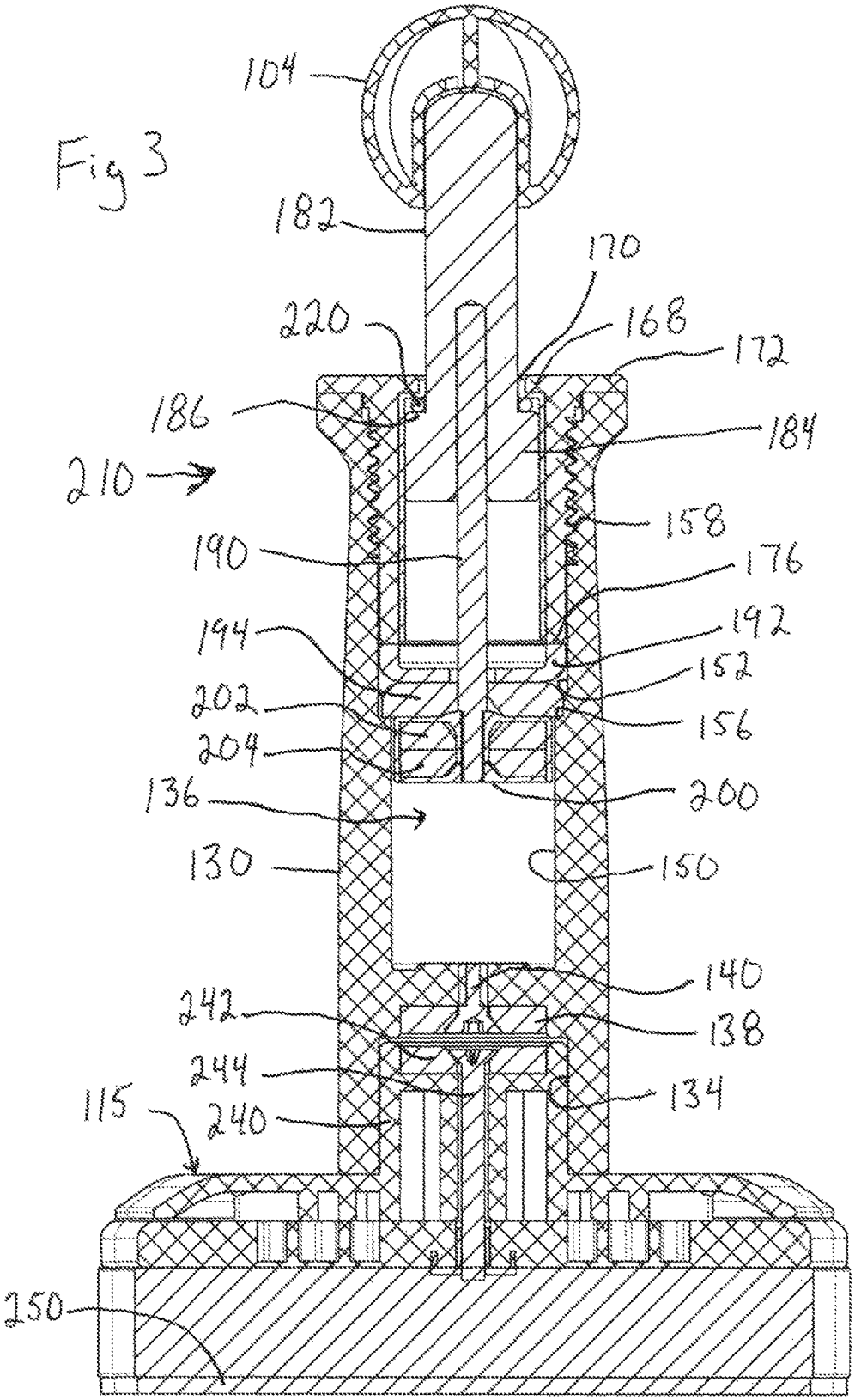
FIG. 3 is a side elevation sectional view of a manual strike head configuration of the modular fascia manipulation tool embodiment shown in the start position.
Figure 4:
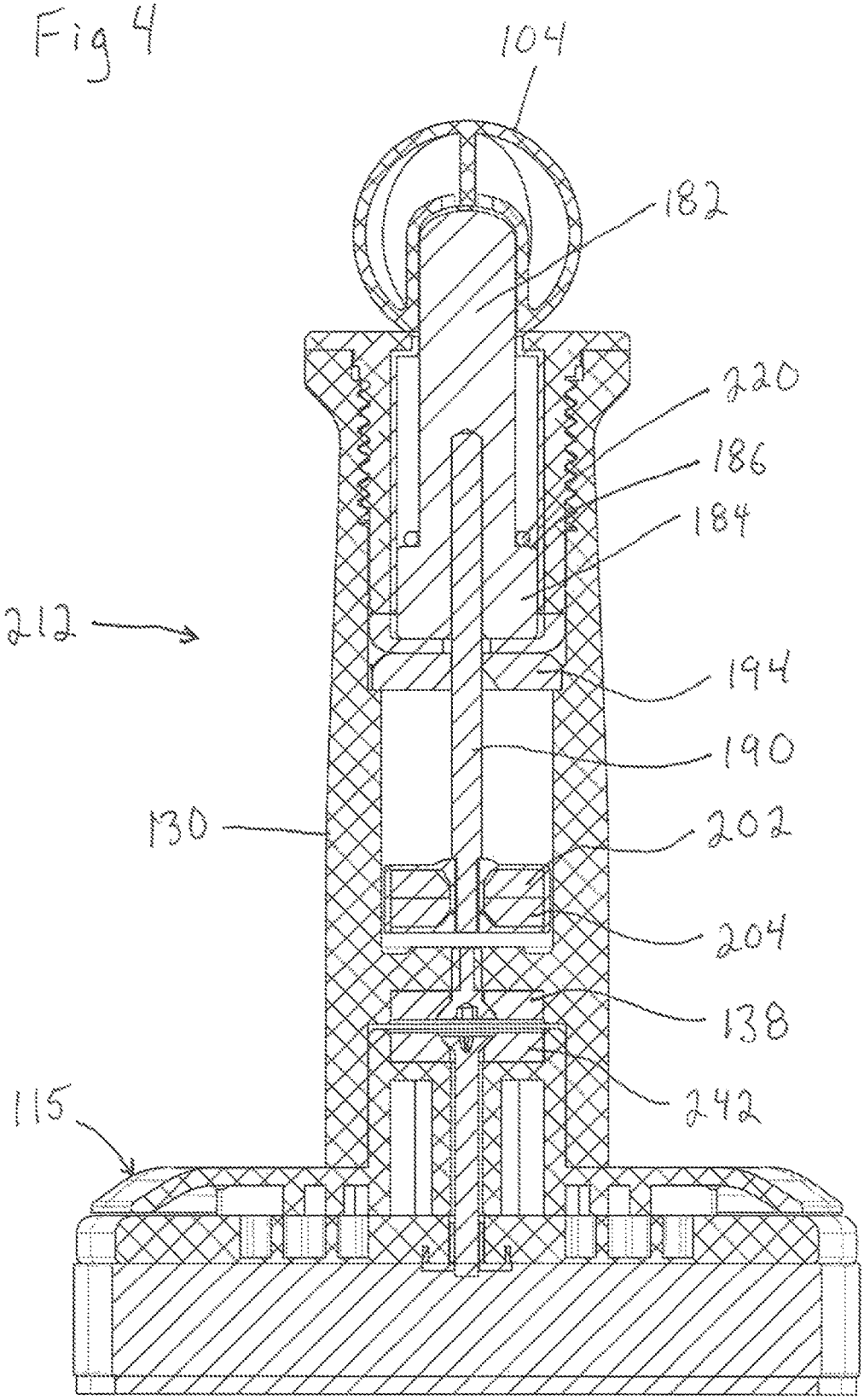
FIG. 4 is a side elevation sectional view of the manual strike head configuration shown in FIG. 3, shown in the collapsed position.
Figure 5:
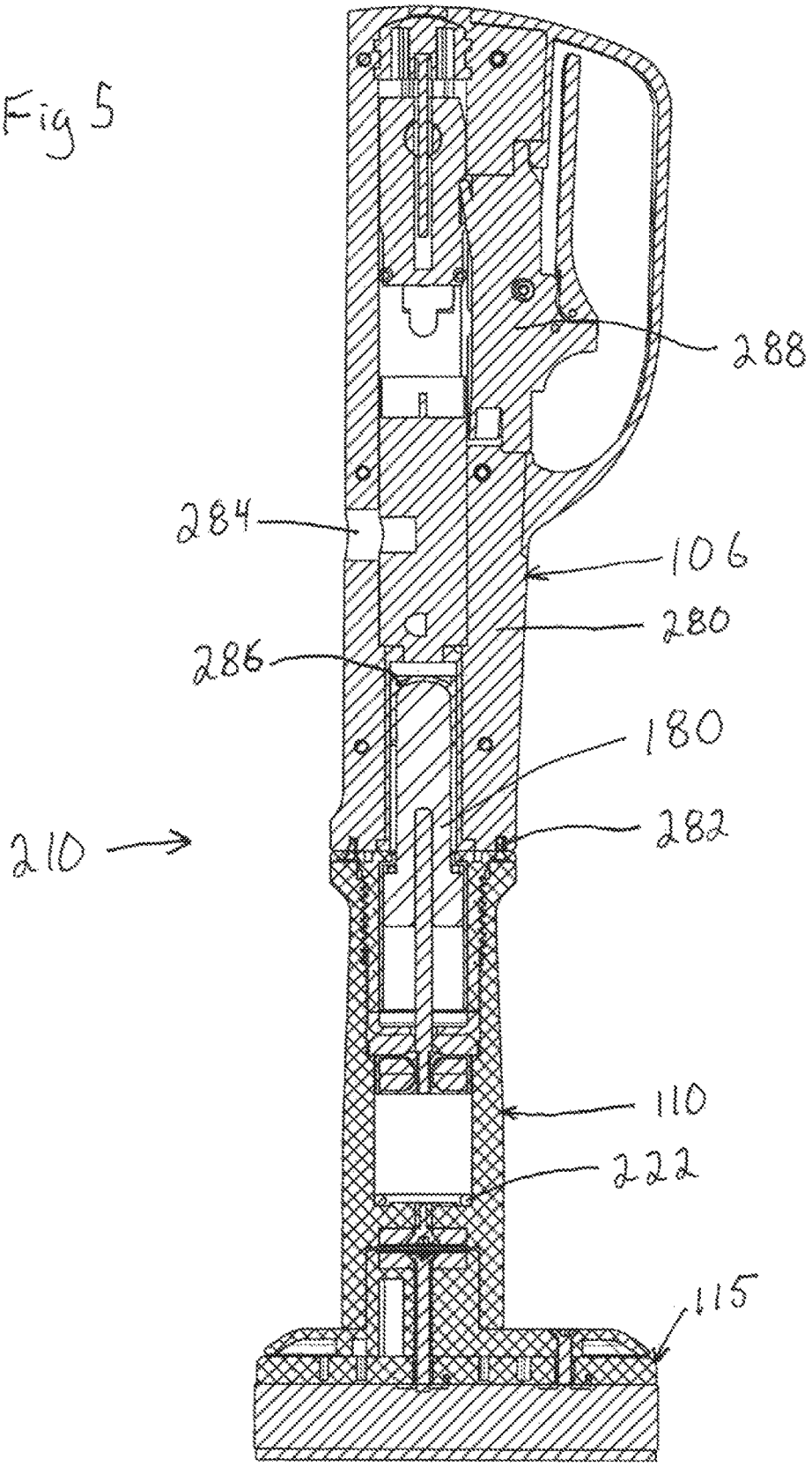
FIG. 5 is a side elevation sectional view of a pneumatic strike head configuration of the modular fascia manipulation tool embodiment shown in the start position.
Figure 6:
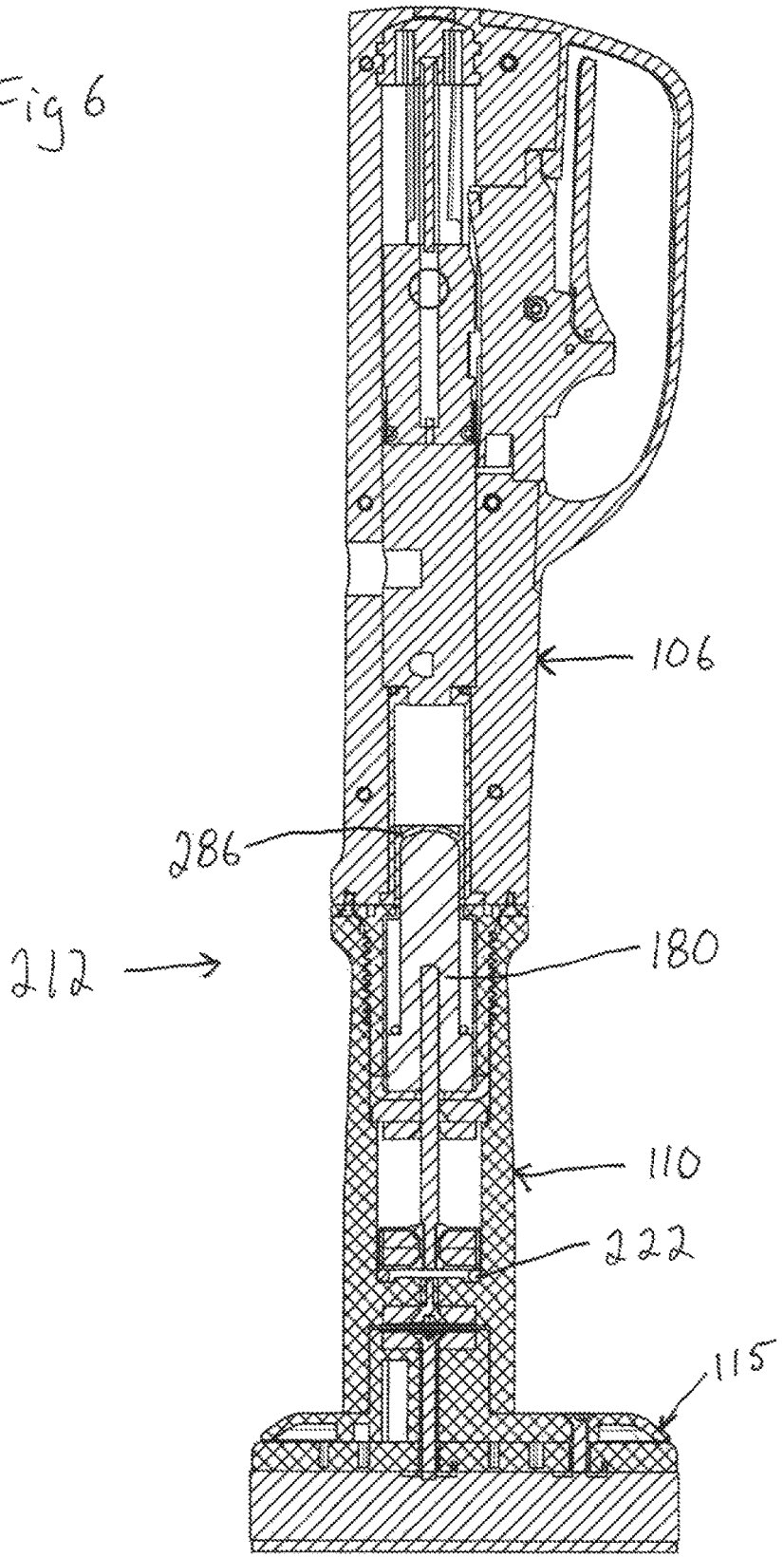
FIG. 6 is a side elevation sectional view of the pneumatic strike head configuration shown in FIG. 5, shown in the collapsed position.
Figure 7:
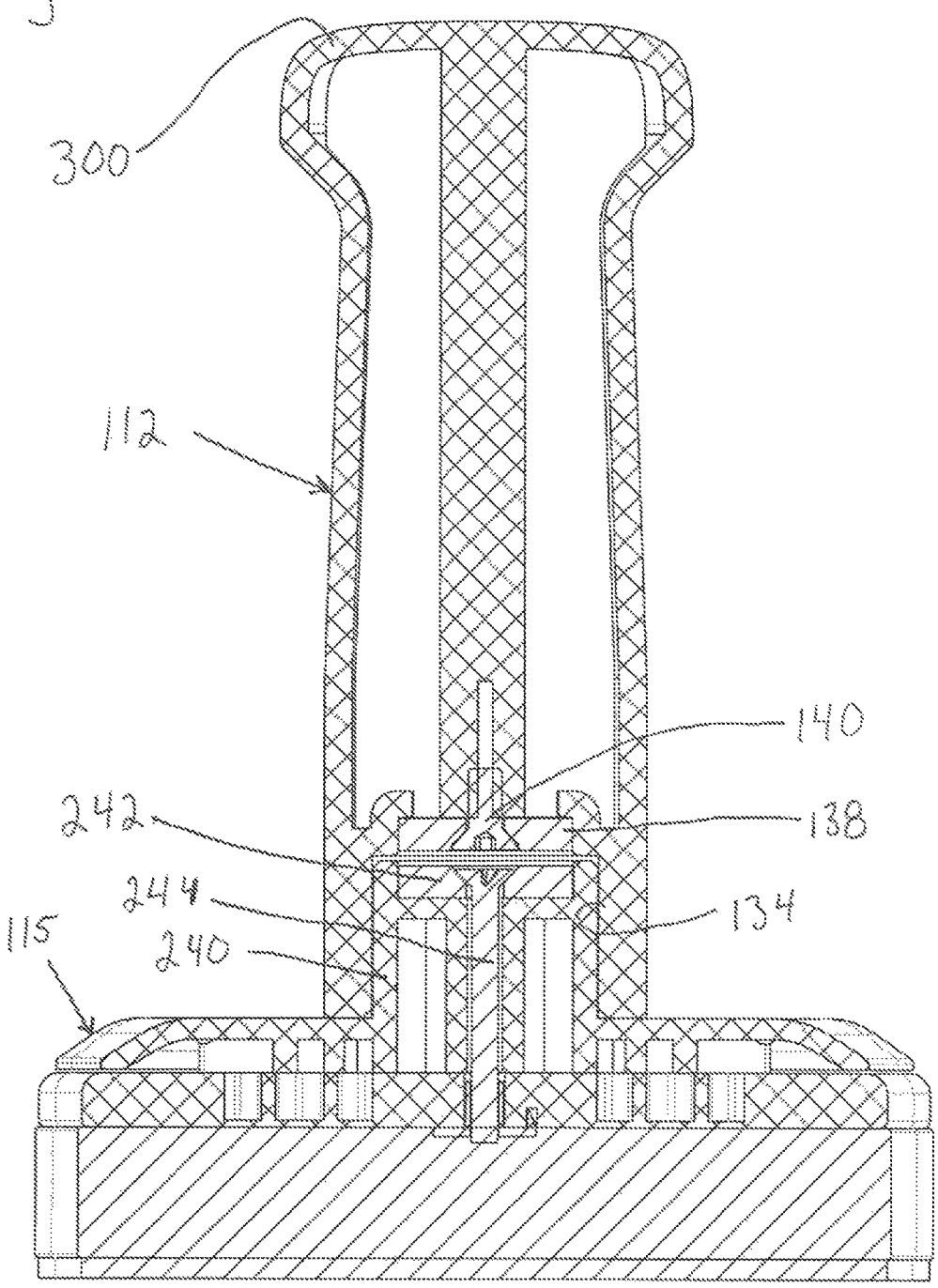
Figure 8:
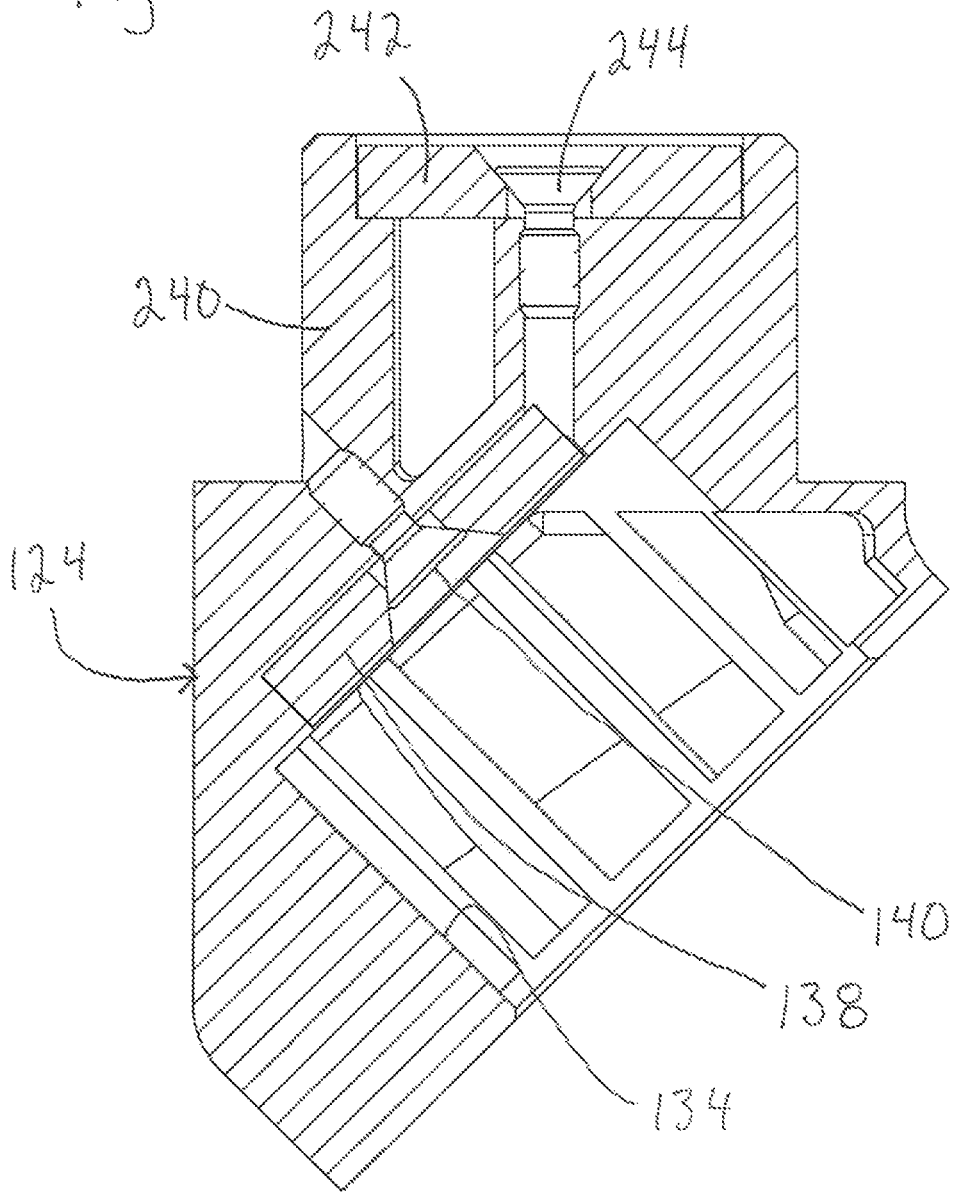
FIG. 8 is a side elevation sectional view of the angled adaptor of the modular fascia manipulation tool embodiment.
Figure 9:
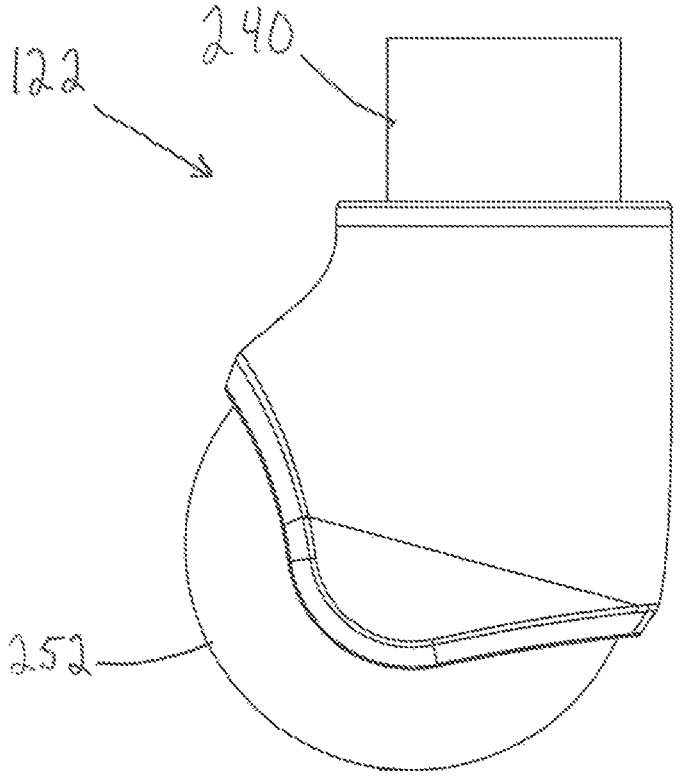
FIG. 9 is a side elevation view of the spherical pad of the modular fascia manipulation tool embodiment.

As shown in the drawings, embodiments of the present invention include a modular fascia manipulation tool 100 comprising three general classes of cooperating components, being: a strike head 102 (being interchangeably, a manual strike head 104 and a pneumatic strike head 106), a force transmitter 108 (being interchangeably, a force modulator 110 and a direct transmitter 112), and a patient interface 114 (including, interchangeably, three triangular pads 115 (a small pad 116, medium pad 118, large pad 120) and a spherical pad 122, and the patient interface 114 also including an optional angled adapter 124).

In use, a strike force generated at or by the strike head 102 is transmitted by the force transmitter 108 (and normalized/modulated in the case of the force modulator 110 as described below), to the patient interface 114 and thence to patient tissue.

The force modulator 110 includes a modulator body 130 configured to provide an external grip 132, an interface receptacle 134 and a piston chamber 136.

A receptacle magnet 138 is fixed within the interface receptacle 134 by a receptacle magnet retaining screw 140.

The piston chamber 136 has an inner chamber 150 and a block chamber 152. The diameter of the inner chamber 150 is smaller than the diameter of the block chamber 152, and the meeting of the inner chamber 150 and block chamber 152 define an annular chamber seat 156. The block chamber 152 includes internal block chamber threads 158.

A piston block assembly 160 is engaged with the block chamber 152. The piston block assembly 160 includes: a piston block 162 having external piston block threads 164, a piston cylinder 166, a piston retainer lip 168 defining a piston head opening 170, a block flange 172 having flange screw holes 174, and an annular block foot 176; a piston 180 having a piston head 182 sized to pass through the piston head opening 170 and a piston body 184 having a diameter larger than the piston head 182, the piston head 182 and piston body 184 separated by an annular piston shoulder 186; a piston rod 190 projecting from the piston body 184 and passing through a block magnet compression washer 192 and a block magnet 194; a piston magnet enclosure 200, containing a proximal piston magnet 202 and a distal piston magnet 204, is affixed to the distal end of the piston rod 190.

As indicated in the drawings: the piston block 162 is attached to the modulator body 130 by threaded engagement between the block chamber threads 158 and the piston block threads 164; the block magnet compression washer 192 and block magnet 194 are secured between the chamber seat 156 and the block foot 176; and the piston 180 is retained within the piston cylinder 166 by the piston retainer lip 168 and piston shoulder 186.

The receptacle magnet 138, block magnet 194, proximal piston magnet 202, distal piston magnet 204 and plug magnet 242 (described below) are "rare earth" neodymium magnets. In the embodiment shown in the drawings, the receptacle magnet 138, block magnet 194, proximal piston magnet 202, distal piston magnet 204 and plug magnet 242 are "ring" magnets, meaning they are flat circular magnets, each having a center hole and having the magnetic poles on the flat sides. As indicated in the drawings, on one side of each magnet, the center hole is countersunk to receive the head of a flat-head machine screw.

In the embodiments shown in the drawings, the block magnet 194 is a "cupped" magnet having a cup diameter of 1¼ inches and a magnet diameter of 15/16", and rated as having a ⅜" plate pull force (i.e., the average force required in a straight pull to disengage the magnet from a ⅜ inch steel plate) of 69 pounds. A suitable cupped magnet is Lee Valley Tools Ltd.'s product 99K39.09.

In the embodiments shown in the drawings, the receptacle magnet 138, proximal piston magnet 202, distal piston magnet 204 and plug magnet 242, are 1 inch in diameter and 3/16 inch thick, and have a pull force (i.e., the average pounds of force required in a straight pull to disengage the magnet from a steel plate) of about 20.5 pounds.

The receptacle magnet 138, proximal piston magnet 202, distal piston magnet 204 and plug magnet 242, are each one of two possible magnetic pole configurations, being: one configuration in which the north magnetic pole is on the side of the magnet in which the center hole is countersunk (referred to at times herein as a "north magnet") and another configuration in which the south magnetic pole is on the side of the magnet in which the center hole is countersunk (referred to at times herein as a "south magnet"). A suitable north magnet is K&J Magnetics, Inc.'s product RX033CS-N. A suitable south magnet is K&J Magnetics, Inc.'s product RX033CS-S.

The receptacle magnet 138, block magnet 194, proximal piston magnet 202, distal piston magnet 204 and plug magnet 242 are selected and oriented so as to provide an attractive force between the block magnet 194 and the proximal piston magnet 202; an attractive force between the proximal piston magnet 202 and the distal piston magnet 204; a repulsive force between the distal piston magnet 204 and the receptacle magnet 138; and an attractive force between the receptacle magnet 138 and the plug magnet 242. Thus, with the orientations of the countersunk end of the center hole shown in the drawings, if the side of the block magnet 194 with the countersunk end of the center hole is the north magnetic pole of the block magnet 194, then the proximal piston magnet 202 is a south magnet, the distal piston magnet 204 is a north magnet, the receptacle magnet 138 is a south magnet and the plug magnet 242 is a south magnet. Conversely, if the side of the block magnet 194 with the countersunk end of the center hole is the south magnetic pole of the block magnet 194, then the proximal piston magnet 202 is a north magnet, the distal piston magnet 204 is a south magnet, the receptacle magnet 138 is a north magnet and the plug magnet 242 is a north magnet.

The attractive force between the block magnet 194, and the proximal piston magnet 202 and distal piston magnet 204, tends to maintain the force modulator 110 in a start position 210. If a strike force is applied to the piston head 182 that is less than the force required to disengage the proximal piston magnet 202 and distal piston magnet 204 from the block magnet 194, the force is transmitted directly through the modulator body 130.

If a strike force is applied to the piston head 182 that is greater than the force required to disengage the proximal piston magnet 202 and distal piston magnet 204 from the block magnet 194, the portion of the strike force up to the disengagement threshold is transmitted through the modulator body 130 and the portion of the strike force in excess of the disengagement threshold is not transmitted through the modulator body 120, in that the excess strike force is dissipated through movement of the piston 180, piston rod 190, piston magnet enclosure 200, proximal piston magnet 202 and distal piston magnet 204, away from the start position 210 and toward the collapsed position 212.

In the vicinity of the collapsed position 212, the repulsive force between the receptacle magnet 138, and the proximal piston magnet 202 and distal piston magnet 204, tends to resist movement toward the collapsed position 212 (i.e., essentially providing a decelerating cushioning effect). When this repulsive force is greater than the force causing the movement toward the collapsed position 212, the movement toward the collapsed position 212 ceases and a movement toward the start position 210 commences. The attractive force between the block magnet 194, and the proximal piston magnet 202 and distal piston magnet 204, tends to accelerate movement toward the start position 210.

The magnets described above and the following dimensions have been found to provide a functional force transmission modulation (comprising a break force, i.e., the force required to break the magnetic attraction engagement between the block magnet 194, and the proximal piston magnet 202 and distal piston magnet 204, of about 14.5 pounds) and reset (i.e., return to the start position 210 from the collapsed position 212), in a desirable size of force modulator 110 (e.g., with respect to ease of gripping by the user). The portion of the piston magnet enclosure 200 between the block magnet 194 and the proximal piston magnet 202, and thus the space between the block magnet 194 and the proximal piston magnet 202 in the start position, is 0.8 mm. The distance of travel between the start position 210 and the collapsed position 212 is 29.12 mm. The distance between the distal piston magnet 204 and the receptacle magnet 138 when the force modulator 110 is in the collapsed position 212 is 29.12 mm. The distance between the receptacle magnet 138 and the plug magnet 242 of a plug 240 inserted in the interface receptacle 134, is 2.16 mm.

It is clear that functional embodiments could be achieved through the selection of other magnet combinations and other dimensions.

It is understood that it may be possible to provide the magnetic effect of the magnets (e.g., the block magnet 194) through an electromagnet rather than a rare earth magnet, and thus that adjustment of the force required for disengagement could be adjusted by adjusting the current to the magnet. It is also understood that it may be possible to provide for adjustment of the force required for disengagement by means for making user selected fine adjustments in the distance between the block magnet 194 and the proximal piston magnet 202.

Rare earth magnets tend to be brittle and may chip or shatter when subject to impact. The piston magnet enclosure 200 is preferably configured to enclose and support the proximal piston magnet 202 and distal piston magnet 204 so as to prevent, or at least impede, such chipping or shattering. To further mitigate the impact force that may be imparted to the block magnet 194, proximal piston magnet 202 and distal piston magnet 204, the modular fascia manipulation tool 100 preferably includes: a piston head O-ring 220 disposed about piston head 182 adjacent the piston shoulder 186 and thus interposed between the piston shoulder 186 and the piston retainer lip 168; and a piston chamber O-ring 222 disposed in the piston chamber 136 between the piston magnet enclosure 200 and the end of the piston chamber 136.

The patient interface 114 components are easily swappable to allow for different angulations of strike, and strike surface materials and shapes.

The small pad 116, medium pad 118, large pad 120, and spherical pad 122 each have a plug 240, having a plug magnet 242 and plug magnet retaining screw 244, and configured for insertion into the interface receptacle 134, wherein magnetic attraction between the receptacle magnet 138 plug magnet 242 tends to retain the plug 240 within the interface receptacle 134. It will be apparent that the plug magnet 242 could be replaced with a non-magnetized but magnetically responsive component (, an iron allow or other ferromagnetic material).

The small pad 116, medium pad 118 and large pad 120 each have a planar patient contact surface 250 wherein the direction of the strike force is perpendicular to the planar patient contact surface 250 and thus is substantially perpendicular to patient skin with which the planar patient contact surface 250 is in contact.

The angled adapter 124 has an interface receptacle 134 and an angled adaptor plug 246 at 45 degrees from linear alignment with each other. Thus, the angled adapter 124 may be interposed between each of the small pad 116, medium pad 118 and large pad 120, and the force transmitter 108, so as to provide substantially a 45 degree angle between the strike force direction and patient skin with which the planar patient contact surface 250 is in contact.

The spherical pad 122 has a spherical patient contact surface 252, which permits the user to vary the angle between the strike force direction and patient skin with which the spherical patient contact surface 252 is in contact.

The planar patient contact surface 250 of each of the small pad 116, medium pad 118 and large pad 120 shown in the drawings, has an approximately equilateral-triangular configuration. In the preferred embodiment, the triangle side length of the small pad 116 is about 80 mm, of the medium pad 118 is about 100 mm and of the large pad 120 is about 130 mm. In the preferred embodiment, the diameter of spherical portion of the spherical patient contact surface 252 is about 63 mm. Other possible patient contact surface shapes include ovoid, cylindrical, blunt-tipped conical etc.

The planar patient contact surface 250 and spherical patient contact surface 252 are configured to frictionally engage the patient's skin while minimizing injury. In prototypes of the modular fascia manipulation tool 100, the planar patient contact surface 250 and spherical patient contact surface 252 have been provided by a PVC coated polyester reinforced fabric overlying layers of felt. The PVC fabric has been found to provide acceptable friction, while being non-absorbent, easily cleaned and non-abrasive. A suitable material for the planar patient contact surface 250 and spherical patient contact surface 252 would be any material suitable for skin contact and having a relatively high amount of grab/grip on the skin (i.e., friction) while causing minimal harm to the skin. Suitable higher friction interface materials include rubber or rubberized-type materials. Lower friction surfaces may be desirable when doing delicate and/or localized fascial manipulation. Suitable lower friction interface materials include a smoother vinyl-type surface with less grab/grip. In the prototype, the felt provides a desirable cushioning that evens out the distribution of contact between the planar patient contact surface 250 or spherical patient contact surface 252, and the patient's skin (i.e., reducing localized "hard spots" of contact) while being sufficiently firm to transmit the strike force. It is understood that various closed-cell foams would also be suitable.

The manual strike head 104 shown in the drawings is generally spherical and engages the piston head 182 in a snug fit. Optionally, the manual strike head 104 could be secured to the piston head 182 with a retainer screw (not shown). The manual strike head 104 may be struck by the user's hand or with a suitable striking object (not shown) such as a mallet.

The pneumatic strike head 106 includes: a pneumatic case 280 that in use is attached to the force modulator 110 by pneumatic retainer screws 282 passing through the flange screw holes 174; an air inlet 284 for connection to an air line (not shown) for receiving pressurized air; a pneumatic piston 286 contained within the pneumatic case 280 and abutting the piston head 182; and a trigger assembly 288, including a user operable trigger 230, for controlling the flow of pressurized air so as to actuate the pneumatic piston 286.

When the pneumatic strike head 106 is connected to a supply of pressurized air, each time the trigger 230 is pressed by the user, the pneumatic piston 286 causes the force modulator 110 to move from the start position 210 to the collapsed position 212 and release of the trigger 230 permits the force modulator 110 to move from the collapsed position 212 back to the start position 210.

The supply of pressurized air to the pneumatic strike head 106 includes a regulator (not shown), to enable the user to tune the strike force as desired. For example, to avoid unnecessary wear on the force modulator 110, the strike force could be set to be at or slightly above the force required to disengage the proximal piston magnet 202 and distal piston magnet 204 from the block magnet 194. Alternatively, if it were desirable to apply to the patient a force less than the force transmitted through disengagement of the proximal piston magnet 202 and distal piston magnet 204 from the block magnet 194, the air pressure could be reduced so as to provide a repeating consistent sub-threshold force.

The direct transmitter 112 is a static body having: an integral strike head 300 suitable for striking with the user's hand (and possibly with striking object such as a mallet); and an interface receptacle 134 (with receptacle magnet 138 and receptacle magnet retaining screw 140) suitable for interconnection with a patient interface 114. It is understood that in use, application of the direct transmitter 112 will be limited to instances when it is desirable to apply a force to a patient's skin that is greater than the modulated force transmitted by the force modulator 110, e.g., to apply much heavier strikes to areas like the thighs and buttocks where tissue is much thicker and stronger fascial adhesions are likely to exist.

As indicated above, in use, other interface surface shapes (e.g., spherical, ovoid etc.) may be angled relative to the skin so as to apply a force to the skin having a lateral component (i.e., a vector component substantially parallel to the surface of the skin). Alternatively, a substantially planar interface surface may be associated with: an angled mount, for example a mount configured to selectively provide any angle, or discrete angles, within a desired range (e.g., 90 to 30 degrees).

The scope of the claims should not be limited by the preferred embodiments set forth in the examples, but should be given the broadest interpretation consistent with the description as a whole.

What is claimed is:

1. A device for use in imparting force to tissue of a patient in need thereof, the device comprising:

user interchangeable force transmitter components, comprising:

a direct transmitter comprising a rigid body through which a strike force is directly conveyed; and a force modulator comprising:

a body, a member supported by and linearly moveable relative to the body between a start position and a collapsed position;

the body includes a first body ferromagnetic component;

the member includes a member ferromagnetic component;

wherein a start magnetic attraction engagement between the first body ferromagnetic component and the member ferromagnetic component is configured to bias the member to the start position;

a strike means for conveying a strike force to the member or the direct transmitter; and a patient interface for conveying a force from the body to skin of a patient;

wherein, during use of the force modulator:

a strike force conveyed to the member that is insufficient to break the start magnetic attraction engagement, is substantially wholly conveyed to the skin of the patient via the body and patient interface; and a strike force conveyed to the member that is sufficient to break the start magnetic attraction engagement, is in part conveyed to the skin of the patient via the body and patient interface and in part dissipated by movement of the member toward the collapsed position.

2. The device of claim 1, wherein a break force required to break the magnetic attraction engagement is about ten pounds to about sixty pounds.

3. The device of claim 2, wherein the break force is about ten pounds to about twenty pounds.

4. The device of claim 3, wherein the break force is about twelve pounds to about seventeen pounds.

5. The device of claim 4, wherein the break force is about fourteen pounds to about fifteen pounds.

6. The device of claim 1, wherein:

the member ferromagnetic component is a magnetic field source; and the body further comprises a collapse magnetic field source;

wherein a magnetic repulsion between the member ferromagnetic component and the collapse magnetic field source is configured to cause the member to move away from the collapsed position.

7. The device of claim 6, wherein:

the patient interface comprises a plurality of patient pads, interchangeably releasably attachable to the body;

each patient pad includes a pad ferromagnetic component; and the releasable attachment of each patient pad to the body involves magnetic attraction between the pad ferromagnetic component and the collapse magnetic field source.

8. The device of claim 7, wherein the patient interface further comprises:

at least one adaptor for releasable interconnection between one of the patient pads and the body, each adaptor comprising:

an adaptor ferromagnetic component, wherein the releasable interconnection between the adaptor and the body involves magnetic attraction between the adaptor ferromagnetic component and the collapse magnetic field source; and an adaptor magnetic field source, wherein the releasable interconnection between the adaptor and the one of the patient pads involves magnetic attraction between the adaptor magnetic field source and the pad ferromagnetic component.

9. The device of claim 8, wherein the at least one adaptor includes a forty-five degree adaptor.

10. The device of claim 7 wherein the patient pads include:

at least one planar pad having a substantially planar patient contact surface; and at least one curved pad having a curved patient contact surface.

11. The device of claim 10, wherein:

the at least one planar pad comprises:

a small triangular pad having a triangle side dimension of about seventy-five millimeters to about eighty-five millimeters;

a medium triangular pad having a triangle side dimension of about ninety-five millimeters to about one hundred five millimeters; and a large triangular pad having a triangle side dimension of about one hundred twenty millimeters to about one hundred forty millimeters; and the at least one curved pad comprises a spherical pad having a diameter of about fifty-five millimeters to about seventy millimeters.

12. The device of claim 6, wherein:

the body has an inner chamber;

the first body ferromagnetic component and collapse magnetic field source are disposed adjacent the inner chamber in a spaced apart relationship; and the member is a piston assembly wherein, the linear movement of the member is movement of the piston assembly relative to the inner chamber, and the member ferromagnetic component is disposed within the inner chamber between the first body ferromagnetic component and collapse magnetic field source.

13. The device of claim 12, wherein:

the first body ferromagnetic component has a center hole therethrough;

the piston assembly comprises a piston rod extending through the center hole, and having longitudinal axis and a piston rod distal end; and the member ferromagnetic component is affixed to the piston rod in the vicinity of the piston rod distal end;

wherein movement between the start position and collapsed position involves longitudinal movement of the piston rod within the center hole.

14. The device of claim 13, wherein:

the first body ferromagnetic component is a first rare earth magnet, wherein the average force required in a straight pull to disengage the first rare earth magnet from a steel plate is about sixty-five pounds to about seventy-five pounds;

the member ferromagnetic component comprises two second rare earth magnets abutting each other under mutual magnetic attraction, wherein for each second rare earth magnet, the average force required in a straight pull to disengage the second rare earth magnet from a steel plate is about seventeen pounds to about twenty-three pounds.

15. The device of claim 14, wherein:

the collapse magnetic field source is a third rare earth magnet, wherein the average force required in a straight pull to disengage the third rare earth magnet from a steel plate is about seventeen pounds to about twenty-three pounds;

in the start position, a start distance between the first rare earth magnet and the second rare earth magnets, is no more than about 1.2 millimeters; and in the collapsed position:

a collapsed distance between the first rare earth magnet and the second rare earth magnets, is between about twenty-five millimeters and about thirty-five millimeters; and a repulsion distance between the second rare earth magnets and the third rare earth magnets is between about five millimeters and fifteen millimeters.

16. The device of claim 1, wherein the strike means comprises a manual strike head for receiving a strike force imparted directly or indirectly manually by a user.

17. The device of claim 1, wherein the strike means comprises a pneumatic device having an inlet for connection to a pressurized gas supply and a control trigger, for imparting a strike force responsive to user trigger manipulation.

18. A modular configurable device for use in imparting force to tissue of a patient in need thereof, the device comprising:

user interchangeable strike head components, comprising:

a manual strike head for receiving a strike force imparted directly or indirectly manually by a user; and a pneumatic device having an inlet for connection to a pressurized gas supply and a control trigger, for imparting a strike force responsive to user trigger manipulation;

user interchangeable force transmitter components, comprising:

a direct transmitter comprising a rigid body through which a strike force is directly conveyed; and a force modulator comprising a body including a first body ferromagnetic component, a member supported by and linearly moveable relative to the body between a start position and a collapsed position, and including a member ferromagnetic component, wherein a start magnetic attraction engagement between the first body ferromagnetic component and the member ferromagnetic component is configured to bias the member to the start position; and user interchangeable patient interface components;

wherein when in use, a strike force generated at or by the user selected strike head is transmitted by the user selected force transmitter to the user selected patient interface and thence to patient tissue.

* * * * *